US011768042B2

(12) United States Patent
Geissele

(10) Patent No.: US 11,768,042 B2
(45) Date of Patent: Sep. 26, 2023

(54) CAM RACE FOR FIREARM

(71) Applicant: WHG Properties, LLC, North Wales, PA (US)

(72) Inventor: William H. Geissele, Lower Gwynedd, PA (US)

(73) Assignee: WHG PROPERTIES, LLC, North Wales, PA (US)

( * ) Notice: Subject to any disclaimer, the term of this patent is extended or adjusted under 35 U.S.C. 154(b) by 18 days.

(21) Appl. No.: 17/372,290

(22) Filed: Jul. 9, 2021

(65) Prior Publication Data

US 2023/0008914 A1 Jan. 12, 2023

(51) Int. Cl.
*F41A 3/66* (2006.01)

(52) U.S. Cl.
CPC ..... *F41A 3/66* (2013.01)

(58) Field of Classification Search
CPC ..... F41A 3/66
See application file for complete search history.

(56) References Cited

U.S. PATENT DOCUMENTS 9,068,793 B1 6/2015 Barrett
10,145,632 B2 12/2018 Dienno
2002/0020284 A1* 2/2002 Murello ..... F41A 9/41 89/33.1
2014/0224114 A1 8/2014 Faxton
2019/0072345 A1* 3/2019 Kramer ..... F41A 5/24

FOREIGN PATENT DOCUMENTS

WO WO 2020/232481 A1 11/2020

OTHER PUBLICATIONS

Extended European Search Report for EP Application No. 22183648.9 dated Dec. 2, 2022 (8 pages).

* cited by examiner

*Primary Examiner* — J. Woodrow Eldred
(74) *Attorney, Agent, or Firm* — Alston & Bird LLP

(57) ABSTRACT

A cam race comprising a hardened material (harder than a material of an upper receiver) is provided to increase durability of a firearm. The cam race is fit within a groove within an interior sidewall of an upper receiver of the firearm. The cam race comprises a body that is fit within the groove, and a plurality of fastener pins extending away from a rear face of the body that fit within corresponding through-holes of the upper receiver. Distal ends of each of the fastener pins are deformed to form a riveted connection between the cam race and the upper receiver. The cam race defines a slide face along which a cam pin of the firearm slides during a firing process, thereby increasing the durability of the firearm against undesired formation of defects within the interior sidewall of the upper receiver.

16 Claims, 9 Drawing Sheets

INSERTION OF CAM RACE INTO UPPER RECEIVER

INSERTION OF CAM RACE INTO UPPER RECEIVER

CAM RACE FOR FIREARM

BACKGROUND

Bolt action firearms (e.g., rifles) include multiple parts that move and slide relative to one another. While regular cleaning and maintenance typically ensures that these parts operate effectively, contaminants and/or improper maintenance may cause certain of these parts to wear prematurely and/or otherwise operate unreliably. Accordingly, a need exists for firearm configurations with increased durability.

BRIEF SUMMARY

Certain embodiments provide a cam race having a hardened surface along which a cam pin slides during a firing operation of a bolt action firearm. The hardened surface minimizes the likelihood of undue wear on components of the firearm (e.g., on the interior surface of the upper receiver of the firearm). The cam race is a separate component, comprising a different material composition (a harder material composition) than the upper receiver to which the cam race is secured. The cam race may be riveted onto the upper receiver, within a slot defined within an interior surface of the upper receiver. The cam race with the fastener pins (to be deformed into rivets) may be integrally formed, thereby minimizing excess parts (e.g., separate fastener components) and ensuring a strong connection between the cam race and the upper receiver.

Certain embodiments are directed to a cam race for an upper receiver of a firearm, the cam race comprising: a body defining a slide face and an opposite rear face; and a plurality of fastener pins extending away from the opposite rear face, wherein the plurality of fastener pins are integrally formed with the body; and wherein the body and the plurality of fastener pins comprise a material selected from: steel or titanium.

In certain embodiments, each of the plurality of fastener pins extend between a base end connected with the opposite rear face and a distal end, and wherein the distal end of each of the plurality of fastener pins is configured for deformation to form a rivet. In some embodiments, the body and the plurality of fastener pins are nitride finished.

Various embodiments are directed to an upper receiver assembly for a firearm, the upper receiver assembly comprising: an upper receiver defining a groove within an interior sidewall, wherein the groove defines a plurality of through-holes extending through the interior sidewall of the upper receiver to an exterior sidewall of the upper receiver; and a cam race comprising: a body defining a slide face and an opposite rear face, wherein the body is positioned within the groove; and a plurality of fastener pins extending away from the opposite rear face, wherein each of the plurality of fastener pins extend through a corresponding through-hole.

In various embodiments, each of the plurality of fastener pins extend between a base end connected with the opposite rear face and a distal end, and wherein the distal end of each of the plurality of fastener pins is deformed at the exterior sidewall of the upper receiver to form a rivet. In certain embodiments, the exterior sidewall defines a raised rail aligned with the groove. In some embodiments, the distal end of each of the plurality of fastener pins is at least substantially planar with the exterior sidewall of the upper receiver. In some embodiments, the distal end of each of the plurality of fastener pins extends beyond the exterior sidewall of the upper receiver. In various embodiments, the exterior sidewall defines a countersink surrounding each of the plurality of through-holes. In certain embodiments, the upper receiver comprises a first material and the cam race comprises a second material; wherein the second material is harder than the first material. In some embodiments, the cam race comprises a hardened steel material.

Certain embodiments are directed to a firearm comprising an upper receiver assembly as described herein.

Certain embodiments are directed to a method of manufacturing an upper receiver assembly for a firearm, the method comprising: forming an upper receiver defining a groove within an interior sidewall, wherein the groove defines a plurality of through-holes extending through the interior sidewall of the upper receiver to an exterior sidewall of the upper receiver; placing a cam race within the groove, wherein the cam race comprises: a body defining a slide face and an opposite rear face, wherein placing the cam race within the groove comprises placing the body within the groove; and a plurality of fastener pins extending away from the opposite rear face, wherein placing the cam race within the groove comprises placing each of the plurality of fastener pins through a corresponding through-hole; and securing the cam race within the upper receiver via the one or more fastener pins.

In some embodiments, securing the cam race within the upper receiver via the one or more fastener pins comprises deforming a distal end of each of the one or more fastener pins to form a riveted connection between the cam race and the upper receiver. In various embodiments, the method further comprises smoothing the distal ends of each of the one or more fastener pins to be at least substantially planar with the exterior sidewall of the upper receiver. In certain embodiments, deforming a distal end of each of the one or more fastener pins comprises: threading the upper receiver onto a support rod such that a surface of the support rod is in contact with the slide face of the cam race; and compressing the distal end of each of the one or more fastener pins via a press to provide a compressive force on each of the fastener pins between the support rod and the press. In various embodiments, forming an upper receiver further comprises forming a raised rail at the exterior surface of the upper receiver, wherein the raised rail is aligned within the groove. In certain embodiments, the method further comprises forming the cam race from a material harder than a material of the upper receiver. In various embodiments, forming an upper receiver further comprises forming countersink surrounding an exterior end of each of the plurality of through-holes.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
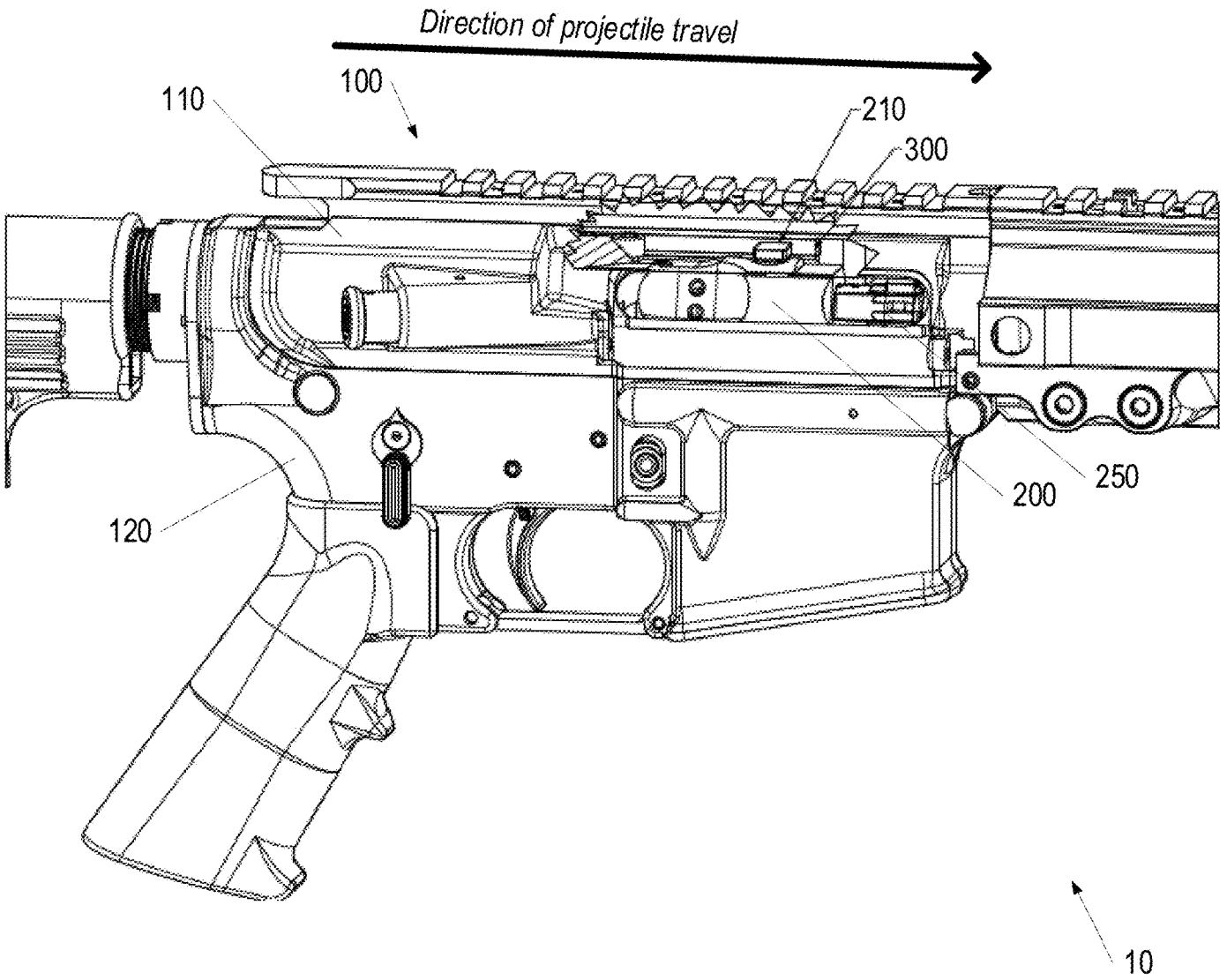
FIG. 1 is a cutaway view of an upper receiver of an example rifle showing the positioning of the cam race.
Figure 2A:
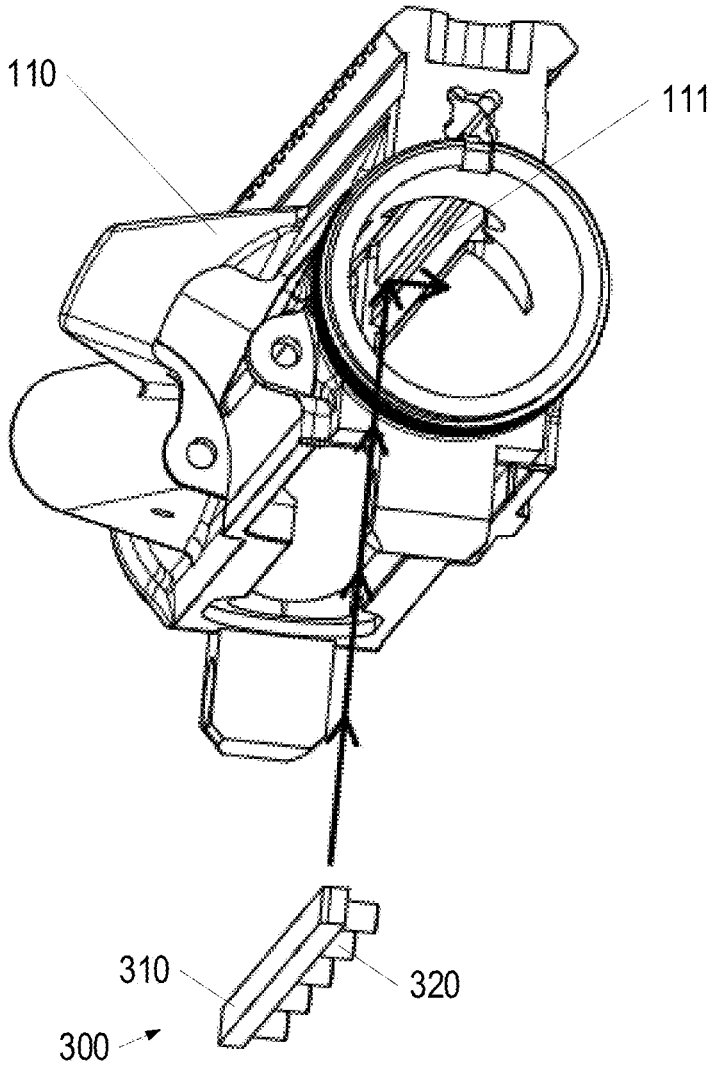
FIG. 2A illustrates how a cam race is inserted and secured into an upper receiver of an example rifle.
Figure 2B:
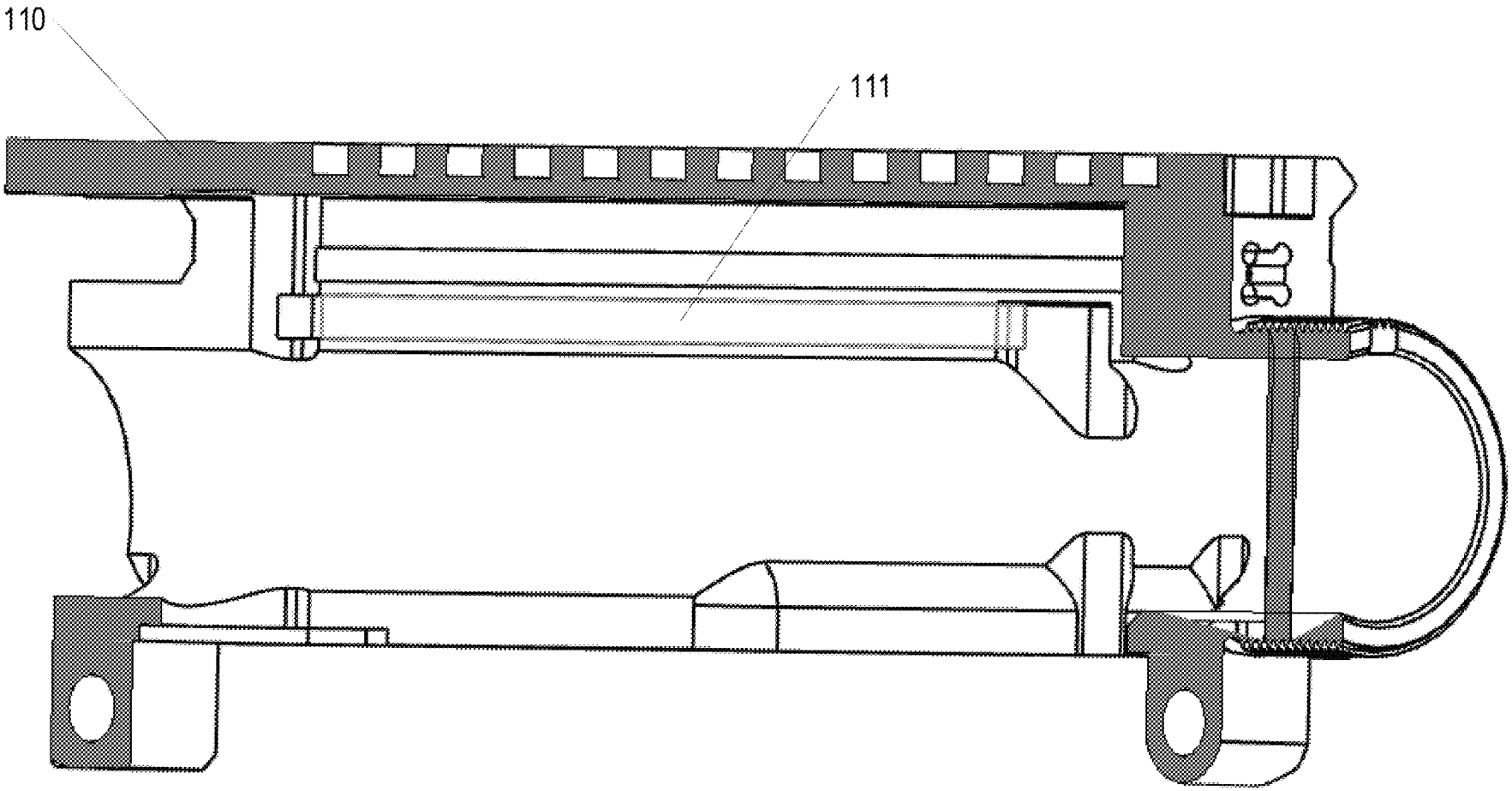
FIG. 2B is a cross-sectional view of the upper receiver illustrating insertion and placement of the cam race within the upper receiver.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

A firearm as discussed herein is a bolt-action gun for discharging a projectile. As a specific example, a firearm is a rifle, such as an AR-15, AR-10, M-16, SR-25, or a variant thereof. However, it should be understood that other firearms may benefit from the configurations discussed herein, and therefore this description should not be construed as being limited in applicability to a single type of firearm.

The receiver assembly 100 encompasses an upper receiver 110 and a lower receiver 120. The receiver assembly 100 houses operational components of the firearm, such as components of the firing mechanism for the firearm. In some embodiments, the receiver assembly 100 houses a spring-biased hammer that is cocked and then released by a sear upon actuating a trigger mechanism within the lower housing 120. The hammer strikes a firing pin carried by a bolt 250 (the bolt 250 being carried by a bolt carrier 200), which is thrust forward within the upper receiver 110 to contact and discharge a cartridge loaded within a chamber to propel a projectile through a barrel of the firearm. Within certain firearms, a portion of the expanding combustion gases traveling down the barrel is discharged off and used to drive the bolt rearward against a forward biasing force of a recoil spring for automatically ejecting the spent cartridge casing and automatically loading a new cartridge into the chamber from a magazine when the bolt returns forward.

The upper receiver 110 defines an internal, longitudinally-extending cavity (extending parallel to the length of the firearm, in a direction parallel to the travel of a projectile exiting the firearm) configured to receive a bolt carrier 200 and bolt 250 (collectively, a bolt assembly). The bolt assembly is slidably positioned within the internal cavity of the upper receiver 110 for axially reciprocating recoil movement therein.

The internal cavity of the upper receiver 110 is defined by cavity sidewalls. A portion of the cavity sidewalls are contoured to the generally cylindrical shape of the bolt assembly to enable smooth sliding of the bolt assembly within the internal cavity. An upper portion of the internal cavity is shaped to accommodate a cam pin 210 extending upward from an upper portion of the bolt carrier 200. The cam pin 210 maintains appropriate rotational positioning of the bolt assembly during reciprocal movement of the bolt assembly. In some firearm configurations, the bolt assembly is biased toward a counter-clockwise rotation (when viewed in the direction of projectile travel) within the internal cavity of the upper receiver 110. This rotational biasing force on the bolt assembly presses the cam pin 210 against an interior sidewall of the upper receiver 110 (e.g., an at least substantially planar portion of the interior sidewall). During reciprocal movement of the bolt assembly during firing, the cam pin 210 remains in contact with the interior sidewall of the upper receiver 110, and slides along the interior sidewall of the upper receiver 110 along an at least substantially linear cam pin travel path extending between a rear position (corresponding to the most-rearward position of the cam pin 210 during recoil movement of the bolt assembly) and a forward position (corresponding to the most-forward position of the cam pin 210 during a firing action of the bolt assembly).

As shown in the cutaway view of FIG. 1, the cam pin 210 slides along a slide face of a cam race 300 secured within a groove of the interior sidewall of the upper receiver 110. The cam race 300 comprises a hardened material resistant to scoring, etching, scratching, denting, or the formation of other defects within a surface thereof. As noted above, the cam pin 210 is biased against the interior sidewall of the upper receiver 110 (specifically, against the slide face of the cam race 300). During use of the firearm, dirt, material slivers from spent casings, and/or other undesired contaminants (e.g., particles) may become lodged between a surface of the cam pin 210 and the slide face. Given the biasing force pressing the cam pin 210 against the slide face, an unhardened surface may become etched or otherwise defective as these small particles are trapped between the cam pin 210 and the interior sidewall of the upper receiver and they slide with the cam pin 210 along the interior sidewall of the upper receiver 110. While regular cleaning of the firearm mitigates the likelihood that these small contaminants are present within the upper receiver (thereby minimizing the likelihood that these contaminants can become lodged between the cam pin 210 and the interior sidewall of the upper receiver 110), there remains a risk that these contaminants can become undesirably lodged within components of the firearm during even short periods of use (particularly when used in inhospitable environments (e.g., dusty/dirty environments with high levels of particle contaminants in the air). Thus, providing a hardened slide face along which the cam pin 210 slides during use of the firearm further mitigates potential damage to the interior surface of the upper receiver 110 that may cause malfunction of the firearm.

As an example, the cam race 300 comprises a steel material, such as a hardened stainless steel. The hardened steel material of certain embodiments is a steel alloy, such as 4340 steel alloy. In certain embodiments, the hardened steel material is further treated (e.g., after forming the cam race 300) to provide additional durability. Other example materials comprise titanium, carbon steel, other steel alloys, and/or other materials that are highly wear-resistant. At least a portion of the cam race 300 is heat treated. At least a portion of the cam race 300 is polished and/or has a nitride finish to provide desired frictional properties to facilitate sliding of the cam pin 210 along the slide face. It should be understood that other finishing techniques, surface treatments, and/or the like may be provided to the cam race 300 to provide desired surface properties of the cam race 300. Moreover, it should be understood that other hardened materials may be formed into the cam race 300, provided that the other hardened materials are sufficiently durable to mitigate the likelihood of damage to the surface of the cam race 300 that may result from contaminants trapped between the cam pin 210 and slide face during typical use of the firearm.

Compared with the material of the upper receiver 110 (e.g., typically an aluminum material for weight saving), the cam race 300 provides increased durability to the firearm, with a negligible increase in weight to the firearm.

Figure 4A:
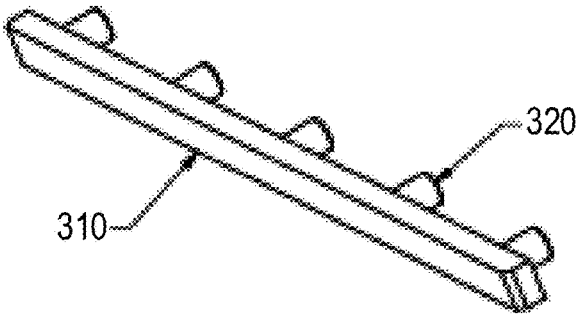
FIGS. 4A-4C are isometric views of an example cam race.
Figure 4B:
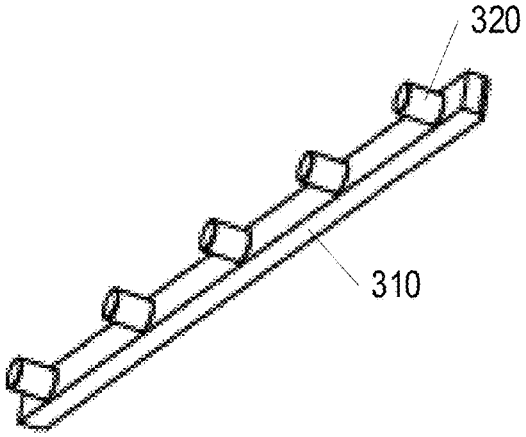
Figure 4C:
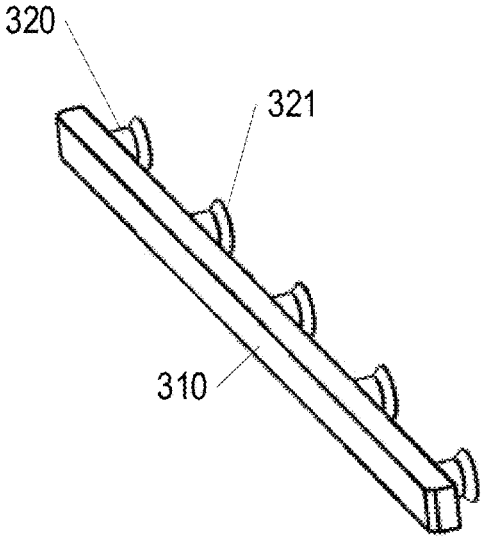

FIGS. 4A-4C illustrate an example cam race 300 isolated from other components of the firearm. As shown in FIGS. 4A-4C, the cam race 300 is an elongated component—having a length equal to or longer than the linear cam pin travel path discussed above. The cam race 300 has a body 310 defining a slide face and an opposite rear face. The thickness of the body (between the slide face and the opposite rear face) corresponds to a depth of a groove 111 into which the cam race 300 is installed within the interior surface of the upper receiver 110, such that the slide face is at least substantially planar with the interior surface of the upper receiver 110 when installed therein. In other embodiments, the slide face protrudes relative to the interior surface of the upper receiver 110. As shown in FIG. 4A, a front end and a rear end (on opposite ends of the length of the cam race 300) of the slide face are chamfered, to facilitate movement of the cam pin 210 across the front end or the rear end of the slide face in the event the cam pin 210 travels beyond the linear cam pin travel path.

The cam race 300 has a height (measured perpendicular to the length and the thickness) sufficient to ensure the cam pin 210 does not contact the interior surface of the upper receiver 110, and/or to ensure that contaminants cannot be caught directly between the cam pin 210 and a portion of the interior surface of the upper receiver 110. For example, the cam race 300 of certain embodiments has a height larger than a height of the cam pin 210 (or at least larger than a contact surface of the cam pin 210 that directly contacts the interior sidewall of the upper receiver 110).

Figure 3A:
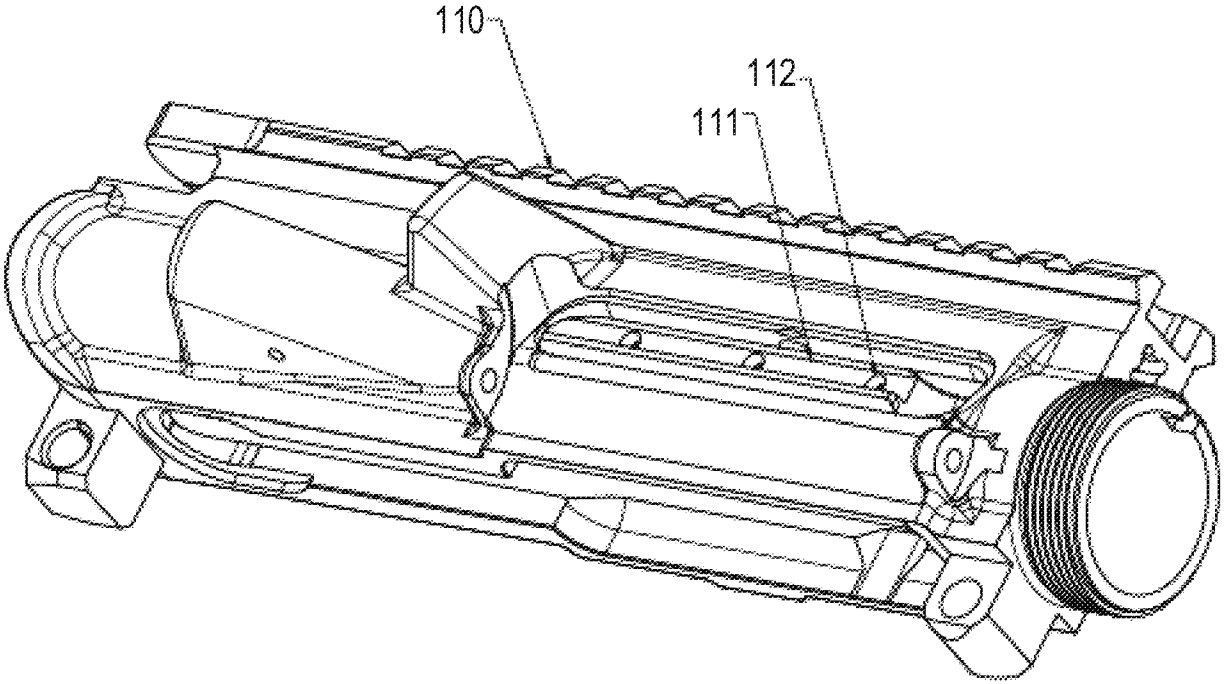
FIG. 3A is a cutaway view of an upper receiver of an example rifle showing the configuration of a groove for accepting an example cam race.
Figure 3B:
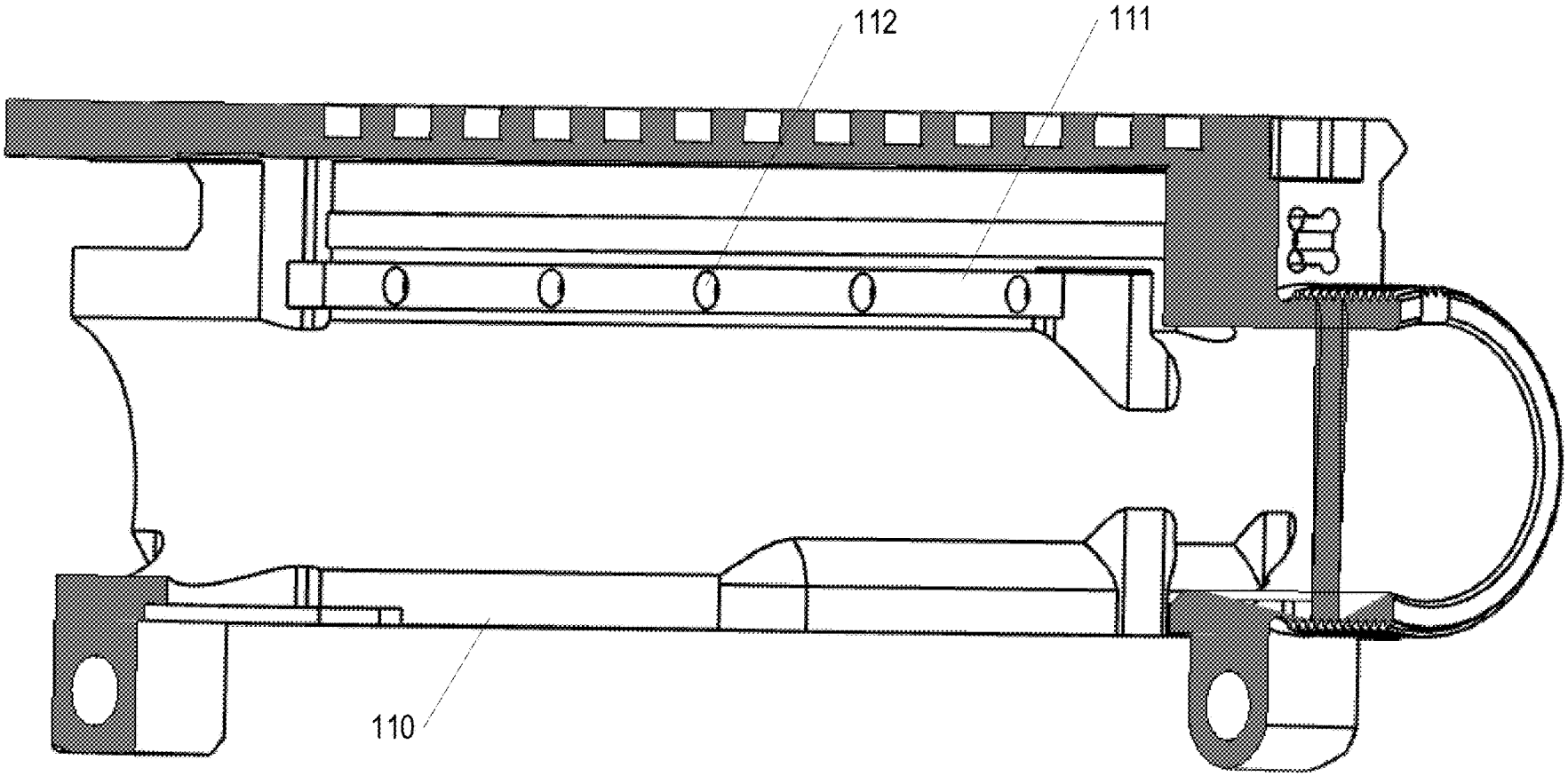
FIG. 3B is a cross-sectional view of an upper receiver of an example rifle showing the configuration of a groove for accepting an example cam race.
Figure 7B:
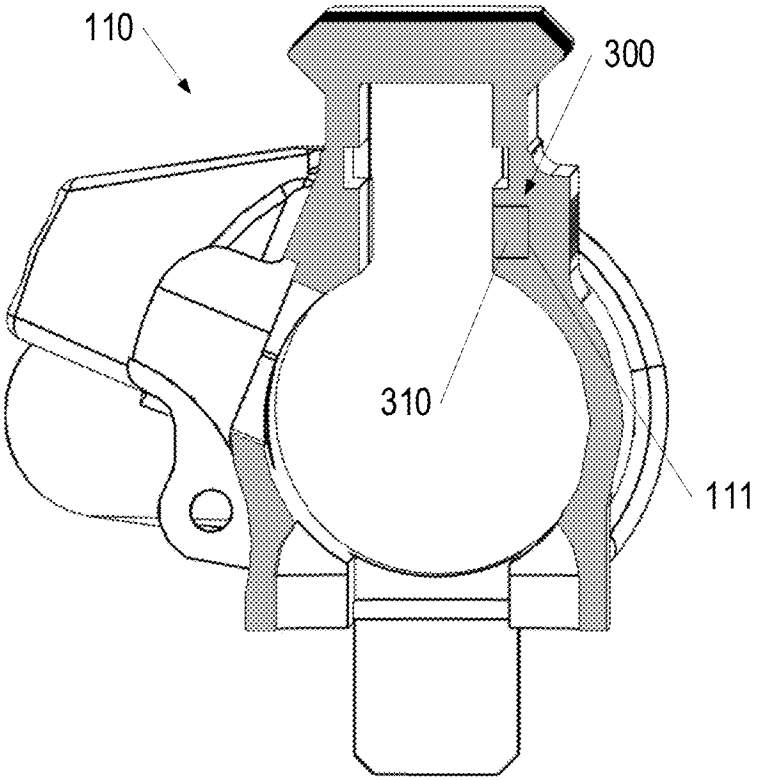
FIGS. 7A-7B are cross-sectional views of a cam race inserted into a groove of an upper receiver.
Figure 7A:
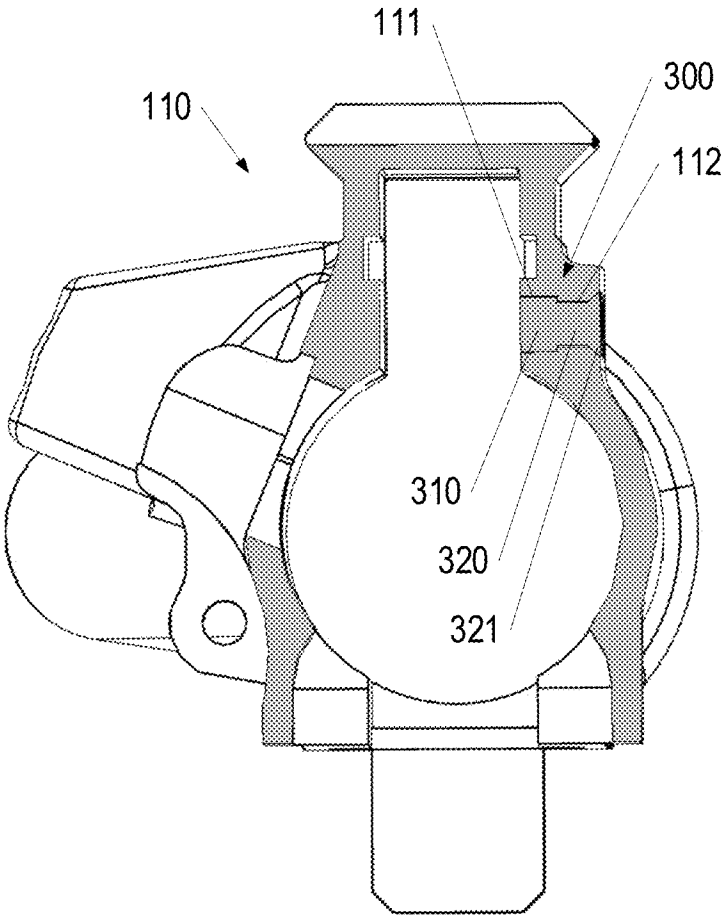

As illustrated in FIGS. 1, 2A-2B, and 7A-7B (FIGS. 7A-7B showing cross-sectional views at different locations along a length of the upper receiver 110), the cam race 300 is secured within a groove 111 (shown in FIGS. 3A-3B) within the interior sidewall of the upper receiver 110. The rear face of the cam race 300 contacts an interior surface of the groove 111. Moreover, to ensure the cam race 300 is positioned appropriately within the groove 111, the height and length of the groove 111 are sized slightly larger than the cam race 300 to enable the cam race 300 to slide into the groove 111 without resistance. In other embodiments, the height and length of the groove 111 are sized to provide a friction fit between the sidewalls of the groove 111 and sidewalls of the cam race 300.

The cam race 300 is secured to the upper receiver 110 via one or more fasteners. The fasteners may be integrally formed with the cam race 300, such as fastener pins 320 extending away from the rear face of the cam race 300 as shown in FIGS. 4A-4B. The fastener pins 320 extend from a pin base (where the fastener pin is formed with the rear face of the cam race 300) to a distal end. The fastener pins 320 are at least substantially linear between the pin base and the distal end prior to installation, as shown in FIGS. 4A-4B. In the illustrated embodiment, the fastener pins 320 have a circular cross-section (such that the fastener pins 320 define a cylindrical shape), however it should be understood that other cross-sectional shapes (e.g., rectangular, square, oval, triangular, and/or the like) maybe utilized in certain embodiments. In the illustrated embodiment, the fastener pins 320 extend through corresponding rivet through-holes 112 extending through the sidewall of the upper receiver 110 (from the interior surface through an exterior surface of the upper receiver 110). The rivet through-holes 112 have a cross-sectional shape corresponding to the cross-sectional shape of the fastener pins 320. The rivet through-holes 112 are sized to accommodate the fastener pins 320 (having a diameter slightly larger than the diameter of the fastener pins 320 to enable the fastener pins 320 to slide into corresponding rivet through-holes 112). In some embodiments, the rivet through-holes 112 have a diameter (or cross-sectional size) to provide a friction fit with the corresponding fastener pins 320.

Figure 6A:
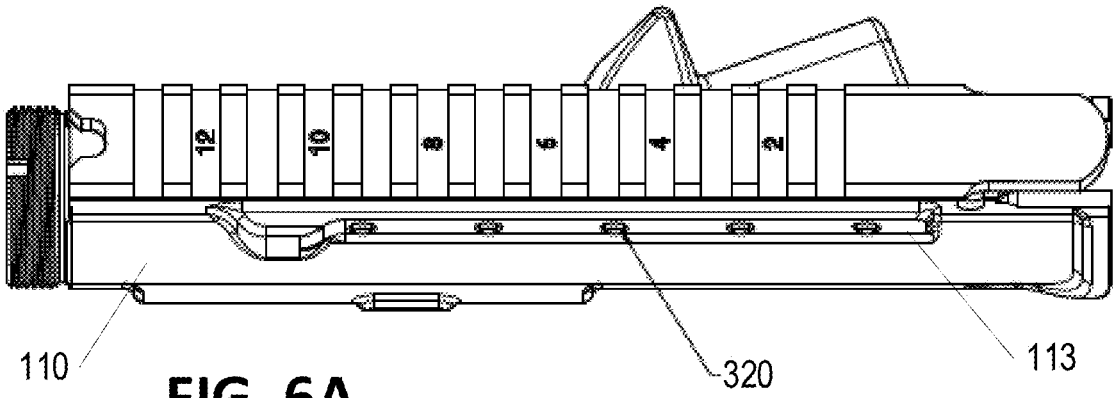
FIGS. 6A-6C are example alternative rivet configurations for securing a cam race relative to an example upper receiver.
Figure 6B:
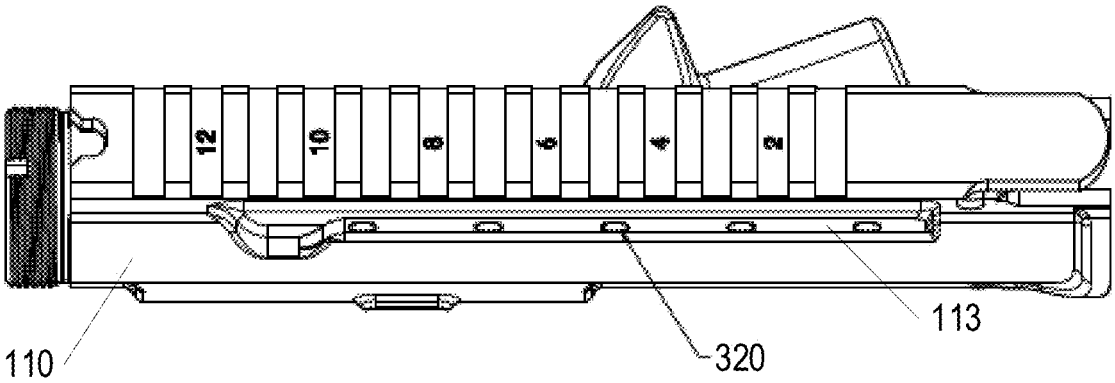
Figure 6C:
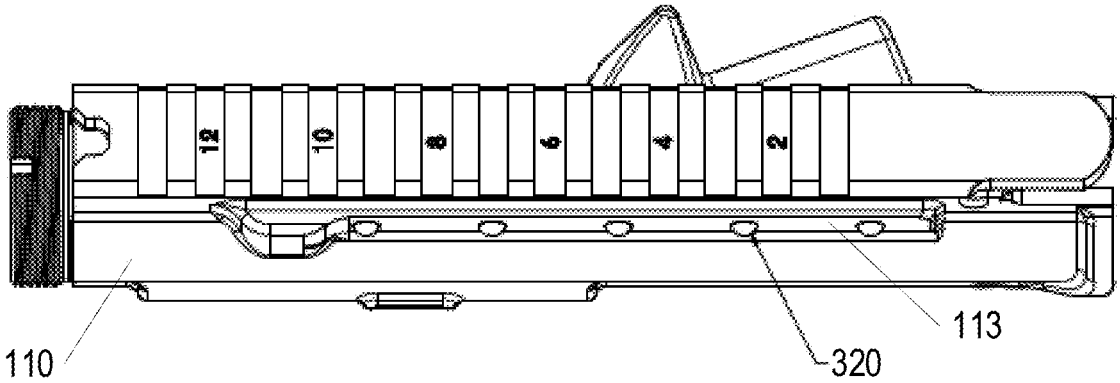

With the cam race 300 positioned within the groove 111 and the fastener pins 320 extending through corresponding rivet through-holes 112, distal ends of the fastener pins 320 are compressed to deform those distal ends of the fastener pins 320 to form expanded portions 321 (as shown in FIG. 4C, which illustrates an example shape of the fastener pins 320 after installation into an upper receiver 110 having rivet through-holes 112 with countersink surrounding an exterior end of the through-holes 112)—such that the distal ends of the fastener pins 320 are enlarged to a diameter larger than the diameter of the rivet through-holes 112, thereby securing the cam race 300 onto the upper receiver 110. As reflected in the embodiments of FIGS. 6B-6C, the distal ends of the rivets may have an at least substantially flat exterior that is at least substantially flush with the exterior surface of the upper receiver 110 (with the enlarged diameter of the distal end fitting within a countersink surrounding the exterior surface end of the through hole 112) or the distal ends of the rivets may protrude beyond the exterior surface of the upper receiver 110 (e.g., in a dome shape, a cone shape, or another three-dimensional shape extending beyond the exterior surface of the upper receiver).

In the illustrated embodiments of FIGS. 5A-6C, the exterior surface of the upper receiver 110 defines a raised rail 113 that is aligned with the groove 111 such that the groove 111 at least partially extends into the raised rail 113. The raised rail 113 ensures the thickness of the upper receiver 110 is adequate to support the rivet-based connection between the cam race 300 and the upper receiver 110, even with the presence of the groove 111 within the interior sidewall of the upper receiver 110. The raised rail 113 has a length (measured in the direction of projectile travel) longer than the length of the groove 111 and a height taller than the height of the groove 111. The thickness of the of the raised rail 113 (measured between the plane of the surrounding exterior surface of the upper receiver 110 and the plane of the outermost surface of the raised rail 113) is sufficient to maintain a secure connection between the upper receiver 110 and the cam race 300 during the assembly process discussed herein.

Figure 5A:
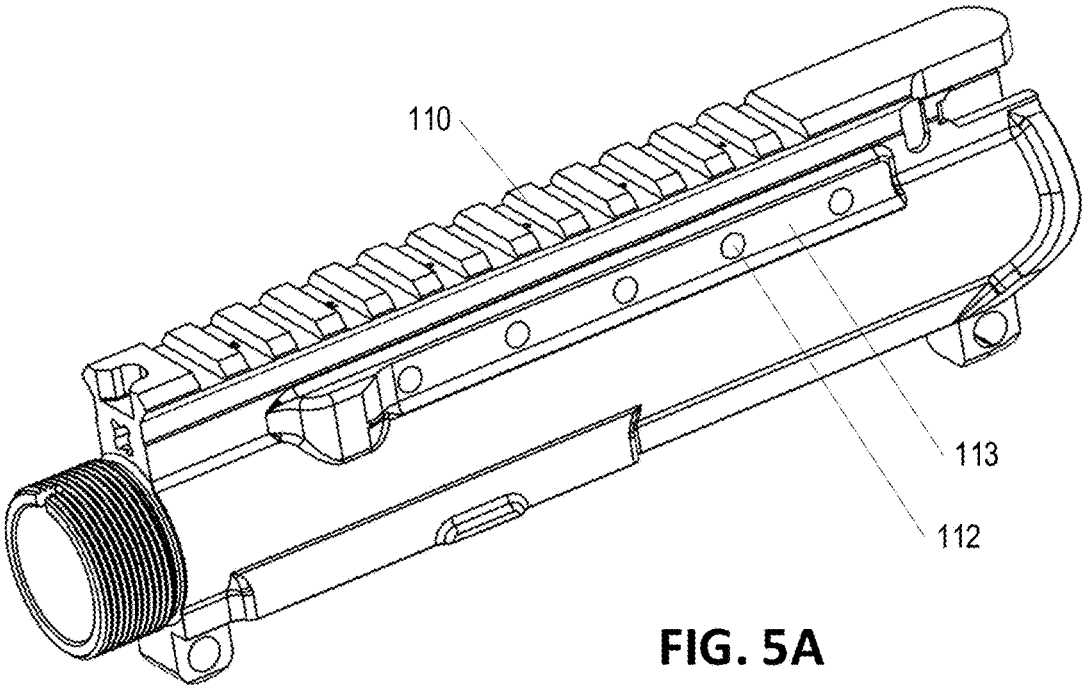
FIGS. 5A-5B are exterior views of an example upper receiver.
Figure 5B:
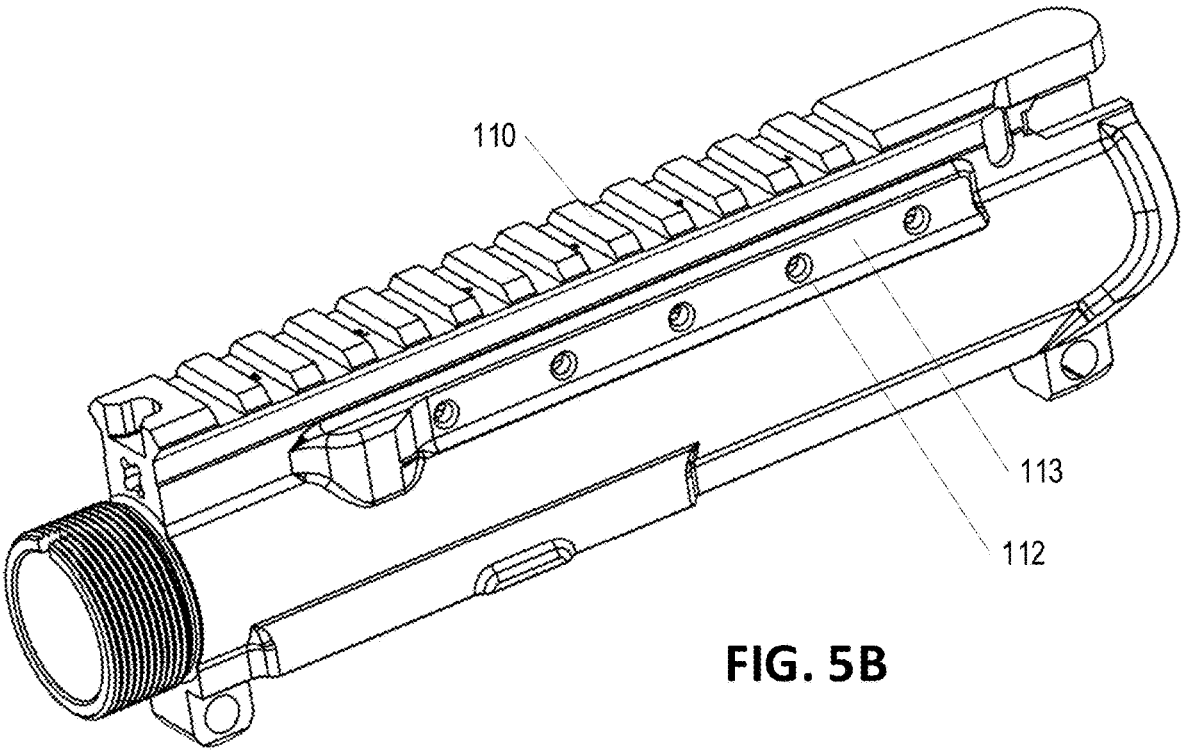

As shown in FIG. 5A, the rivet through-holes 112 may be at least substantially linear, having an at least substantially equal diameter along the length of each rivet through hole 112. However, as shown in FIGS. 5B and 7A, the rivet through-holes 112 may be characterized by a countersink surround an exterior end of each through-hole 112, which may facilitate the formation of a structurally-sound connection between the cam race 300 and the upper receiver 110, while maintaining a desired aesthetic appearance (e.g., a planar exterior surface of the raised rail 113) of the upper receiver 110.

As additionally illustrated in the figures, the cam race 300 comprises a plurality of fasteners (e.g., a plurality of fastener pins, such as 5 fastener pins) along the length of the cam race 300 to securely position the cam race 300 relative to the upper receiver 110. The fasteners may be evenly spaced along the length of the cam race 300, although other fastener spacing may be provided in certain embodiments. For example, the fasteners may have a keyed spacing, such that the cam race 300 can only be inserted in a single orientation (e.g., with an uneven fastener spacing to ensure that the cam race 300 only fits into the groove 111 when inserted in a desired orientation).

It should be understood that other fastener configurations may be provided for securing the cam race 300 into the upper receiver 110. For example, separate rivets may be secured onto both the upper receiver 110 and the cam race 300. Screws or other fasteners may be utilized in place of the described rivet configurations. In yet other embodiments, the plurality of fastener pins may extend into corresponding blind rivet holes, having detents, protrusions, or other features within the sidewalls of those blind rivet holes to provide a feature for interacting with an enlarged distal end of the fastener pins to provide a riveted connection between the cam race 300 and the upper receiver 110. In yet other embodiments, the fastener configuration may be characterized by different fastener pin 320 configurations. For example, a first subset of the plurality of fastener pins 320 may extend entirely through corresponding through-holes, such that distal ends of those fastener pins 320 may be deformed to form enlarged portions 321. A second subset of the plurality of fastener pins 320 may extend partially through corresponding through-holes, or partially into corresponding blind holes, such that the second subset of the plurality of fastener pins 320 assist in placement of the cam race 300, but they are not utilized to secure the cam race 300 onto the upper receiver 110.

Method of Manufacturing

The cam race 300 is inserted and secured into the upper receiver 110 after the upper receiver 110 is formed (e.g., via forging, casting, machining, polishing, surface treatment, and/or the like). The upper receiver 110 is formed of a first material, such as an aluminum material.

The upper receiver 110 is formed with the raised rail 113 integrally formed therewith. For example, the casting mold utilized for forming the upper receiver 110 includes a feature corresponding with and configured for forming the raised rail 113 on the outer surface of the upper receiver 110. Moreover, the upper receiver 110 is additionally formed with the groove 111 formed within an interior wall of the upper receiver 110 and the rivet through-holes 112. The groove 111 and/or the rivet through-holes 112 may be cast and/or machined from the upper receiver 110. In certain embodiments, the rivet through-holes 112 are formed with a countersink portion at an exterior end thereof. As discussed herein, the countersink portion accepts a portion of the deformed distal end of the fastener pins 320 to minimize the amount of material that extends beyond the exterior surface of the raised rail 113 from the fastener pins 320.

The cam race 300 is formed of a second material, such as a hardened steel material as discussed above. The cam race 300 is finished via polishing, coating, surface treatment, and/or the like to provide a desired final finish to the cam race 300. As mentioned, the body 310 and the fastener pins 320 are integrally formed (to form a single continuous piece of material). It should be understood that the cam pins 320 may be modified to accommodate a desired fastener type for a particular embodiment and/or replaced with a different fastener type, as required by the particular embodiment.

Once the upper receiver 110 is formed and the cam race 300 is formed, the cam race 300 is inserted into the groove 111 of the upper receiver 110, such that the fastener pins 320 extend through corresponding rivet through-holes 112 of the upper receiver 110. The upper receiver 110 is then placed onto a support rod—such that the support rod extends through the entire interior length of the upper receiver 110 (through a front and rear opening of the upper receiver 110). The support rod has a surface that at least substantially matches the surface contour of the slide face of the cam race 300. For example, the support rod may have an at least substantially planar surface. The support rod is placed such that the surface of the support rod is in contact with the cam race 300 while the support rod is threaded through the upper receiver 110. In certain embodiments, the support rod had a high rigidity to mitigate bending while subject to the high pressures necessary to deform the distal ends of the fastener pins 320 to secure the fastener pins 320 within their corresponding rivet through-holes 112.

Once the upper receiver 110 is placed on the support rod, a press contacts the distal ends of each of the fastener pins, and a high force is applied to the distal ends of each of the fastener pins (simultaneously or consecutively) to deform the distal ends of the fastener pins—thereby increasing the diameter of the distal ends of the fastener pins to a diameter larger than the diameter of the rivet through-holes 112, thereby locking the cam race 300 into the groove 111 of the upper receiver 110. The fastener pins 320 are effectively crushed between the support rod and the press. Because each of the components (the body 310 and the length of each of the fastener pins 320 with the exception of a short length adjacent the distal ends) are fit into a corresponding groove 111 or rivet through-hole 112 with the exception of the distal ends of the fastener pins 320, only the distal ends of the fastener pins 320 deform, such that the fastener pins 320 form an at least substantially "mushroom" shape, such that the enlarged-diameter distal ends of the fastener pins 320 cannot pass through the corresponding rivet through-holes 112 having a diameter smaller than the crushed distal ends of the fastener pins 320 as reflected within the cross-sectional view of FIG. 7A.

Although not required, the distal ends of the fastener pins 320 may be machined to provide a desired aesthetic to the firearm. The distal ends of the fastener pins 320 may be smoothed relative to the surface of the raised rail 113 to provide an at least substantially planar surface of the raised rail. In such an embodiment, the material of the distal ends of the fastener pins 320 located within the countersink surrounding the rivet through-holes remains sufficiently secure to maintain connection between the cam race 300 and the upper receiver 110, even with the removal of excess material extending beyond the outermost surface of the raised rail 113. In other embodiments, the distal ends of the fastener pins 320 may be shaped (e.g., into a dome shape, a pyramid shape, or any other shape, if not already provided for during the pressing process discussed above).

The remainder of the firearm is assembled according to assembly methodologies appropriate to the particular firearm, such that a cam pin 210 is placed into contact with the slide face of the cam race 300.

CONCLUSION

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cam race for an upper receiver of a firearm, the cam race comprising:

a body defining a slide face and an opposite rear face; and a plurality of fastener pins extending away from the opposite rear face, wherein the plurality of fastener pins are integrally formed with the body;

wherein the body is positioned within a groove of the upper receiver, wherein the plurality of fastener pins are received through through-holes extending from the groove to an exterior sidewall of the upper receiver, and wherein the exterior sidewall defines a raised rail aligned with the groove, and wherein the body and the plurality of fastener pins comprise a material selected from: steel or titanium and wherein the body and the plurality of fastener pins are nitride finished.

2. The cam race of claim 1, wherein each of the plurality of fastener pins extend between a base end connected with the opposite rear face and a distal end, and wherein the distal end of each of the plurality of fastener pins is configured for deformation to form a rivet.

3. A firearm comprising the cam race of claim 1.

4. An upper receiver assembly for a firearm, the upper receiver assembly comprising:

an upper receiver defining a groove within an interior sidewall, wherein the groove defines a plurality of through-holes extending through the interior sidewall of the upper receiver to an exterior sidewall of the upper receiver, wherein the exterior sidewall defines a raised rail aligned with the groove; and a cam race comprising:

a body defining a slide face and an opposite rear face, wherein the body is positioned within the groove; and a plurality of fastener pins extending away from the opposite rear face, wherein each of the plurality of fastener pins extend through a corresponding through-hole.

5. The upper receiver assembly of claim 4, wherein each of the plurality of fastener pins extend between a base end connected with the opposite rear face and a distal end, and wherein the distal end of each of the plurality of fastener pins is deformed at the exterior sidewall of the upper receiver to form a rivet.

6. The upper receiver assembly of claim 5, wherein the distal end of each of the plurality of fastener pins is at least substantially planar with the exterior sidewall of the upper receiver.

7. The upper receiver assembly of claim 5, wherein the distal end of each of the plurality of fastener pins extends beyond the exterior sidewall of the upper receiver.

8. The upper receiver assembly of claim 4, the through-holes formed through the exterior sidewall of the upper receiver align with through-holes in the raised rail, wherein the exterior sidewall defines a countersink surrounding each of the plurality of through-holes in the raised rail.

9. The upper receiver assembly of claim 4, wherein the upper receiver comprises a first material and the cam race comprises a second material; wherein the second material is harder than the first material.

10. A firearm comprising the upper receiver assembly of claim 4.

11. A method of manufacturing an upper receiver assembly for a firearm, the method comprising:

forming an upper receiver defining a groove within an interior sidewall, wherein the groove defines a plurality of through-holes extending through the interior sidewall of the upper receiver to an exterior sidewall of the upper receiver, wherein forming an upper receiver further comprises forming a raised rail at the exterior surface of the upper receiver, wherein the raised rail is aligned with the groove;

placing a cam race within the groove, wherein the cam race comprises:

a body defining a slide face and an opposite rear face, wherein placing the cam race within the groove comprises placing the body within the groove; and a plurality of fastener pins extending away from the opposite rear face, wherein placing the cam race within the groove comprises placing one or more of the plurality of fastener pins through a corresponding through-hole; and securing the cam race within the upper receiver via one or more of the plurality of fastener pins.

12. The method of claim 11, wherein securing the cam race within the upper receiver via the one or more fastener pins comprises deforming a distal end of each of the one or more fastener pins to form a riveted connection between the cam race and the upper receiver.

13. The method of claim 12, further comprising smoothing the distal ends of each of the one or more fastener pins to be at least substantially planar with the exterior sidewall of the upper receiver.

14. The method of claim 12, wherein deforming a distal end of each of the one or more fastener pins comprises:

threading the upper receiver onto a support rod such that a surface of the support rod is in contact with the slide face of the cam race; and compressing the distal end of each of the one or more fastener pins via a press to provide a compressive force on each of the fastener pins between the support rod and the press.

15. The method of claim 11, further comprising forming the cam race from a material harder than a material of the upper receiver.

16. The method of claim 11, wherein the through-holes formed through the exterior sidewall of the upper receiver align with through-holes through the raised rail, wherein forming an upper receiver further comprises forming countersink surrounding an exterior end of each of the through-holes of the raised rail.

* * * * *